US005432964A

United States Patent [19]

Strell

[11] Patent Number: 5,432,964

[45] Date of Patent: Jul. 18, 1995

[54] FIELD SERVICEABLE MATTRESS AND METHOD FOR MANUFACTURE

[76] Inventor: Brian M. Strell, 20 Lockhern Dr., Livingston, N.J. 07039

[21] Appl. No.: 181,320

[22] Filed: Jan. 13, 1994

[51] Int. Cl.[6] ..... A47C 27/04

[52] U.S. Cl. ..... 5/475; 5/478; 5/471

[58] Field of Search ..... 5/478, 471, 475, 402, 5/409, 259.1; 24/72.5, 72.7

[56] References Cited

U.S. PATENT DOCUMENTS

| | | | |
|---|---|---|---|
| 893,732 | 7/1908 | Hoffmann | 5/259.1 |
| 1,665,534 | 4/1928 | D'Arcy | 5/259.1 |
| 1,804,722 | 5/1931 | Van Hove | 5/475 |
| 3,256,535 | 6/1966 | Anson | 5/471 |
| 3,493,980 | 2/1970 | Haller | 5/478 |
| 3,950,800 | 4/1976 | Garshfield | 5/478 |
| 4,490,866 | 1/1985 | Stanton | 5/471 |
| 5,065,485 | 11/1991 | Zocco | 29/91.1 |

FOREIGN PATENT DOCUMENTS

| | | | |
|---|---|---|---|
| 716494 | 10/1954 | United Kingdom | 5/475 |

*Primary Examiner*—Flemming Saether
*Attorney, Agent, or Firm*—Alvin S. Blum

[57] ABSTRACT

A mattress has a conventional spring core. Top and bottom insulators and padding are held in place by top and bottom cover assemblies. The cover assemblies are completely assembled before application to the core. Each cover assembly includes a horizontal panel with an annular vertical flange around its perimeter. Each flange has a hem in its free edge. Elongate rigid rods are held in the hems. Plastic wire ties on the flanges each enclose an upper rod, a lower rod and a peripheral portion of the core. When the ties are closed down to a reduced diameter, the rods and flanges are drawn together and anchored to the core. One of the cover assemblies has a loop member of a hook and loop fastener secured to the perimeter of the panel. The other cover assembly has an annular border skirt attached to the perimeter of the panel external to the flange with a binding tape covering the seam. The free edge of the border skirt also has a binding tape covering and a hook member of the hook and loop fastener adjacent the tape. The border skirt is pulled over the flanges until hook and loop fasteners can be joined together to seal the mattress. Binding tapes give the appearance of a conventional mattress with covers stitched closed on special mattress sewing machines, whereas the entire mattress can be assembled and disassembled for repairs by one worker with hand tools.

12 Claims, 1 Drawing Sheet

FIELD SERVICEABLE MATTRESS AND METHOD FOR MANUFACTURE

BACKGROUND OF THE INVENTION

1. Field of the Invention

This invention relates to mattresses and, more particularly, to the design and manufacture of innerspring mattresses which can be manufactured and repaired without the use of the huge sewing machines ordinarily employed to stitch together the edges of conventional mattresses.

2. Discussion of the Prior Art

U.S. Pat. No. 5,065,485 to Zocco discusses the problems associated with the manufacture of conventional innerspring mattresses both in the skills and strenous labor required of workers in assembling and finishing the covers. Zocco's structure has a foam frame which has properties quite different from those accepted by the industry.

U.S. Pat. No. 4,490,866 issued Jan. 1, 1985 to Stanton discusses problems associated with repair of mattresses and prior art solutions thereto. Stanton discloses a mattress construction which may be repaired in the field. Spaced apart webs are secured to the top and bottom of certain peripheral coils. The mattress cover skirt is secured to the webs by cotter pin fasteners. Access to the cotter pins is by zipper openings in the cover. This does not provide the tensile forces on the cover which give the conventional mattress its stability.

In order for a mattress structure to be accepted by the industry and the public, it should not sacrifice any of the advantages in function and durability that have been developed for quality mattresses over the years.

SUMMARY OF THE INVENTION

It is, accordingly, an object of the invention to provide an improved structure for innerspring mattresses which can be manufactured and repaired without the use of the large sewing machines required for sewing the covers of conventional mattresses closed. It is another object that the mattress structure retain the desirable attributes of conventional mattress construction including the securing of the flanges to the peripheral coils. It is yet another object that the mattress be capable of manufacture and repair with a reduced level of physical effort and skill. It is yet another object that the mattress be repairable in the field so that the time and expense of transporting the mattress to the factory can be eliminated to thereby greatly reduce the cost of repair and the time when the mattress is unavailable for use. This can be a major economic factor in mattress selection in hotels, hospitals and nursing homes, for example.

The mattress of the invention comprises a coil spring assembly core of conventional construction with conventional top and bottom insulator and padding layers of varying degrees of complexity and quality as desired for a particular market segment. Also box springs may be included in the invention with absent padding.

The covers and flanges and the means for anchoring them to the spring assembly core are unique. Both the top and bottom covers have flanges sewn to their perimeters. The flanges have hems which support rigid, elongate rods. On each of the four sides, top and bottom flanges are drawn together to apply tension to the top and bottom covers and the flanges are secured to the peripheral coils of spring core. This is accomplished by loops which pass over the top and bottom rods in the flanges and one of the wires of the coil. These loops are preferably of the plastic wire or cable tie variety, although other loops such as soft steel wire may be used, as desired. One of the horizontal covers, at its perimeter, is provided with one member of a set of hook and loop fasteners. The other of the covers, at its perimeter, is provided with the finished vertical border, with the joint of vertical border and horizontal cover finished with a sewed on trim tape to cover the joint. This provides a finished edge identical to a conventional mattress edge. The distal edge of the vertical border is also provided with a sewed on trim tape to simulate a conventional finished edge. On the inner aspect of the border, just below the trim tape, the other member of the set of hook and loop fasteners is sewn in place. Both of the covers may be completely finished before assembly of the mattress or box spring, using an ordinary industrial sewing machine. To assemble the mattress, the assembled innerspring core is covered on one face with the appropriate padding and then the horizontal face of one cover is spread flat over the padding with the flanges on all sides extending downward over the vertical sides of the spring assembly with the rigid rods in the hems of the flanges. The assembly is inverted and the padding positioned on the second face of the spring core, with the flanges extending downward over the vertical sides of spring assembly with rigid rods in the hems of the flanges. At intervals around the sides, ties are formed into loops. Each loop encircles an upper rod, a lower rod, and one of the peripheral spring coils. When the loop is pulled snugly closed, the rods are drawn together, putting tension on the horizontal cover faces. By anchoring the flanges to the coils, the cover is secured against movement. The rigid rods spread the tension along the flange so that the number of ties per side is reduced and the forces are distributed over the entire fabric to reduce tearing. After all of the flanges are anchored, the finished border wall is pulled up to cover the vertical sides and the hook and loop fasteners are joined together completely around the perimeter, thereby sealing the outer cover completely to present an appearance substantially identical to a conventional mattress. There is no requirement for the large special mattress sewing machine to manufacture the mattress. The mattress may be disassembled by pulling apart the fastener all along its length, pulling down the finished border wall, and cutting the wire ties. This may easily be done in the room where the mattress is used. One worker may repair a mattress, since there is no need to transport the mattress off site for repair.

These and other objects, advantages and features of the invention will become more apparent when the detailed description is considered in conjunction with the drawings.

DETAILED DESCRIPTION OF PREFERRED EMBODIMENTS

Figure 1:
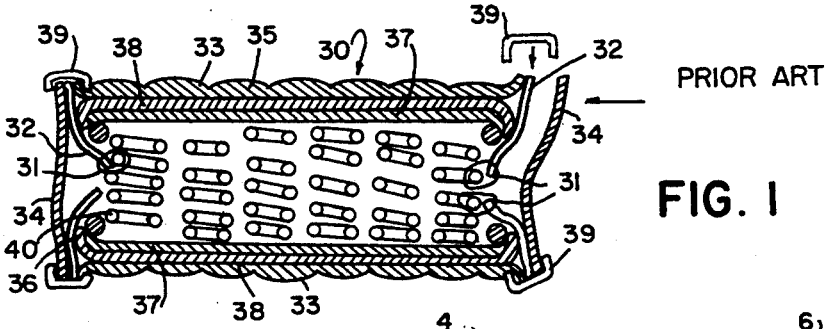
FIG. 1 is a sectional view of a mattress of the prior art.

Referring now first to FIG. 1, a prior art innerspring mattress 30 is shown with a core assembly of coil springs 35. Top and bottom cover panels 33 cover insulator 37 and padding 38 on the horizontal faces of the core 35. An annular flange 32 is sewn to the perimeter of each cover panel. The right side of the mattress is shown partly assembled for clarity. Each flange 32 is pulled down to apply tension to the cover panel and then it is stapled to a peripheral coil 40 with a hog ring 31. A hog ring may be applied to every coil in a quality mattress to distribute the tensile forces uniformly. After both flanges have been stapled in place, a finish border skirt 34 is sewn to the perimeters of the panels with a binding tape 39 covering the seam to provide a finished appearance. Since this must be sewn completely around the mattress, it requires use of a large stationary sewing machine especially manufactured for the purpose, as well as considerable physical effort and skill.

Figure 2:
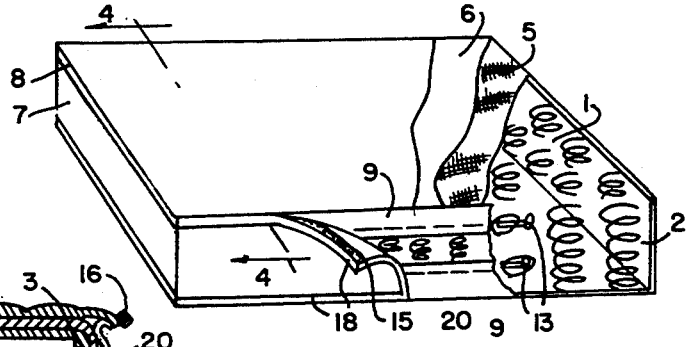
FIG. 2 is a perspective view of a mattress of the invention partially broken away.
Figure 4:
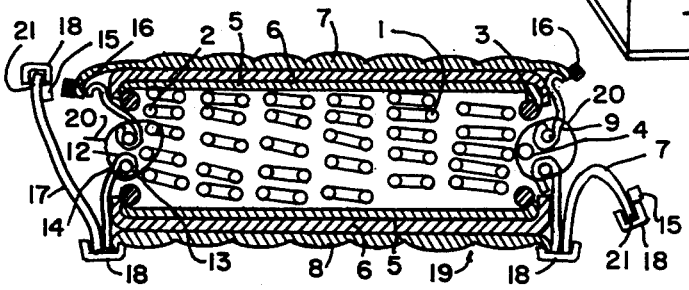
FIG. 4 is a sectional view, taken through line 4—4 of FIG. 2.
Figure 3:
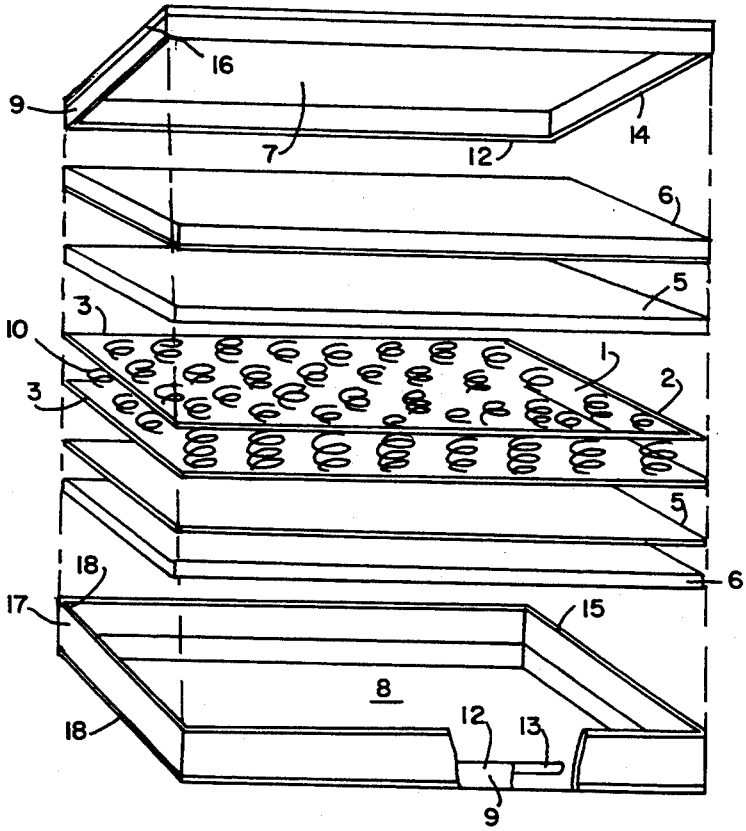
FIG. 3 is an exploded perspective view of a mattress of the invention.

Referring now to FIGS. 2–4, a mattress 19 of the invention is shown comprising an assembly of coil springs forming a core 1. The core may take any form well known in the art, such as with border wires 3 at the upper and lower margins and, optionally, an intermediate border wire 4 as desired. An insulator 5 and padding 6 are applied to the horizontal faces of the core. A bottom cover panel 8 covers the padding and holds it in place. Stitched to the perimeter 11 of cover panel 8 is an annular flange 9, which extends up the sides 10 of the core. Also stitched to the perimeter of panel 8, outside the flange 9 is border skirt 17. The seam joining skirt, flange and panel is covered by stitching on binding tape 18 to provide a finished appearance. The free end 21 of border skirt 17 is likewise finished by a binding tape 18. On the inside face of free end 21, adjacent the binding tape is an elongate hook member 15 of a hook and loop fastening means completely encircling the core. This bottom cover assembly may be completely finished before being fitted to the core.

A top cover panel 7 holds insulator 5 and padding 6 against the upper horizontal face of core 1. At the perimeter of top panel 7, an annular flange 9 is attached. Outside of the flange, at the seam joining panel and flange, an elongate loop member 16 of a hook and loop fastening means is attached. This forms the top cover panel assembly which may also be completely finished before being fitted to the core.

In the free ends 12 of the flanges 9 of both top and bottom cover assemblies, a hem 14 is formed. This is arranged to hold elongate rigid rods or bars, each rod extending along a side of the core. When both top and bottom cover assemblies are in place on the core, with rods 13 in the hems 14, opposing rods are pulled toward one another by a loop 20 which encircles both rods and also a portion of a peripheral coil spring 2. The preferred loop 20 is a plastic wire or cable tie of the type well known in the electrical industry. These are pulled closed manually or by a simple hand tool. They may be readily cut by cutting pliers for disassembly. Because the rods distribute the tension forces along the flange, the loops may be spaced apart widely, in contrast to the prior art where the staples are applied at every peripheral coil in some cases. When the core is provided with an intermediate border wire 4, the loop 20 may incircle the intermediate border wire 4. By anchoring the loop to the core either at a coil or the intermediate border wire, the cover assemblies are pulled taut and also secured against slipping around the core.

After the free edges of the flanges are fastened together and to the sides of the core by loops 20, then the finish border skirt is pulled up over the flanges so that fasteners 15 and 16 are juxtaposed. They are then forced together completely around the edge of the top of the mattress. The upper binding tape 18 extends upward from the fasteners so that they are not visible when closed.

Alternatively, the fastener means may be in other well known forms such as zippers or snaps to serve a similar purpose.

When the mattress is of the type known as a box spring which forms a base upon which another mattress rests, it will be constructed as above without the padding. The term mattress as employed herein applies to mattresses and box springs as the terms are used in the industry.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A mattress structure comprising:

A) a central spring assembly core having broad top and bottom horizontal faces and narrow vertical sides;

B) a pair of cover assemblies, said pair completely enclosing said spring assembly core;

C) a first member of said pair of cover assemblies comprising:

a first fabric panel covering one of said horizontal faces of said core; a first annular vertical flange attached to a perimeter of said first panel; said first flange having a free edge receiving a first plurality of elongated rigid rods or bars; and first fastener means secured to said perimeter of said first panel so as to completely encircle said panel;

D) a second member of said pair of cover assemblies comprising:

a second fabric panel covering the other of said horizontal faces of said core; a second annular vertical flange attached to a perimeter of said second panel; said second flange having a free edge receiving a second a plurality of elongated rigid rods or bars; an annular border skirt attached to said perimeter of said second panel external to said second flange, said border skirt having a free edge provided with second fastener means, said border skirt arranged to extend vertically along said vertical sides of said core to provide for said first and second fastener means to fasten together to completely enclose and seal said mattress structure and said flanges; and E) a plurality of tie elements spaced apart along said free edges of said flanges, each said tie element encircling and drawing toward one another at least one of said first plurality of rods or bars and at least one of said second plurality of rods or bars and also a peripheral portion of said core to anchor said pair of cover assemblies to one another and to said core; to thereby provide a stable mattress structure which can can be assembled and disassembled with hand tools.

2. The mattress structure according to claim 1, further comprising a first binding tape covering said free edge of said border skirt and a second binding tape covering where said border skirt is attached to said second fabric panel to thereby simulate conventional mattress construction.

3. The mattress structure according to claim 2, further comprising insulator and padding interposed between said core and each of said fabric panels.

4. The mattress structure according to claim 3, in which said first and second fastener means are zipper elements.

5. The mattress structure according to claim 3, in which said first and second fastener means are complimentary members of hook and loop fasteners.

6. The mattress structure according to claim 5, in which said peripheral portion of said core is a peripheral coil spring.

7. The mattress structure according to claim 5, in which said peripheral portion of said core is an intermediate border wire.

8. The mattress structure according to claim 5, in which said tie elements are wire or cable.

9. A method of manufacturing a mattress comprising the steps of:

A) providing a spring core assembly having broad top and bottom horizontal faces and narrow vertical sides with peripheral coils;

B) preparing a first cover assembly having: a first fabric panel for covering one of said core assembly faces; a first annular vertical flange attached to a perimeter of said first panel, said first flange having a free edge receiving a first plurality of elongated rigid rods or bars; and fastener means secured to said perimeter of said first panel so as to completely encircle said panel;

C) preparing a second cover assembly having: a second fabric panel for covering the other of said core assembly faces; a second annular vertical flange attached to a perimeter of said second panel, said second flange having a free edge receiving a second plurality of elongated rigid rods or bars; and an annular border skirt attached to said perimeter of said second panel external to said second flange, said border skirt having a free edge provided with second fastener means;

D) applying said first and second cover assemblies to said horizontal faces of said spring core with said flanges extending vertically along said vertical sides;

E) applying, at spaced apart intervals along said flanges, a plurality of loop ties, such that each tie encircles one of the rods or bars in said first cover assembly, one of the rods or bars in said second cover assembly, and a peripheral portion of said core;

F) drawing each of said loop ties down to a reduced diameter to apply tension to said panels and to anchor said cover assemblies to said core;

G) pulling said free edge of said border skirt over said flanges so as to juxtapose said first and second fastener means; and joining together said first and second fastener means to seal said mattress.

10. The method according to claim 9 further comprising the step of interposing insulator and padding between said horizontal faces of said core and said fabric panels.

11. The method according to claim 10, further comprising the steps of: fastening a first binding tape to said free edge of said border skirt; and fastening a second binding tape to where said border skirt is attached to said fabric panel on said second cover assembly.

12. The method according to claim 11, in which said fastening means are hook and loop fasteners.

* * * * *